US008740033B2

(12) United States Patent
Li et al.

(10) Patent No.: US 8,740,033 B2
(45) Date of Patent: Jun. 3, 2014

(54) NAILING GUN

(75) Inventors: Wen-Liang Li, Taichung (TW); Chia-Yu Chien, Taichung (TW)

(73) Assignee: Basso Industry Corp., Taichung (TW)

( * ) Notice: Subject to any disclaimer, the term of this patent is extended or adjusted under 35 U.S.C. 154(b) by 301 days.

(21) Appl. No.: 13/233,501

(22) Filed: Sep. 15, 2011

(65) Prior Publication Data

US 2012/0067934 A1 Mar. 22, 2012

(30) Foreign Application Priority Data

Sep. 16, 2010 (TW) ..... 99131433 A

(51) Int. Cl.
*B25C 1/06* (2006.01)

(52) U.S. Cl.
USPC ..... 227/133; 227/131; 227/134

(58) Field of Classification Search
USPC ..... 227/2, 8, 120, 129, 131–134
See application file for complete search history.

(56) References Cited

U.S. PATENT DOCUMENTS

| | | | | |
|---|---|---|---|---|
| 7,204,403 | B2 * | 4/2007 | Kenney et al. | 227/133 |
| 7,575,141 | B1 | 8/2009 | Liang et al. | |
| 8,123,099 | B2 * | 2/2012 | Kenney et al. | 227/133 |
| 8,231,039 | B2 * | 7/2012 | Buck et al. | 227/133 |
| 8,302,833 | B2 * | 11/2012 | Gross et al. | 227/134 |
| 2005/0217875 | A1 * | 10/2005 | Forster et al. | 173/1 |
| 2005/0218181 | A1 * | 10/2005 | Gross et al. | 227/130 |
| 2011/0259937 | A1 * | 10/2011 | Chien et al. | 227/120 |

* cited by examiner

*Primary Examiner* — Andrew M Tecco
(74) *Attorney, Agent, or Firm* — Merchant & Gould P.C.

(57) ABSTRACT

A nailing gun includes a swing arm having a first end pivoted to a frame, and a second end movable between a first position proximate to a flywheel to drive a hammer rod to hit a nail, and a second position distal from the flywheel. A spring plate has a spring end portion resiliently supporting the second end of the swing arm. The stop member limits the spring end portion and the second end of the swing arm from moving relative to the frame. When a safety member is subjected to an external pressure, the stop member permits the second end of the swing arm to move together with the spring end portion to the first position. The spring end portion can stably retain the second end of the swing arm at the second position in case of no external pressure.

7 Claims, 4 Drawing Sheets

NAILING GUN

CROSS-REFERENCE TO RELATED APPLICATION

This application claims benefit of Taiwan Patent Application No. 99131433, filed on Sep. 16, 2010 and which application is incorporated herein by reference. To the extent appropriate, a claim of priority is made to the above disclosed application.

BACKGROUND OF THE INVENTION

1. Field of the Invention

The invention relates to a nailing gun, more particularly to an electrical nailing gun with a safety mechanism.

2. Description of the Related Art

In U.S. Pat. No. 7,575,141, there is disclosed an actuator for an electrical nail gun. An actuator is arranged in a housing of an electrical nail gun and includes a sliding base, an external-running brushless direct current motor, a swing base and an electric driver. The sliding base is slidably disposed on an end of a located supporter which is positioned in the housing. The sliding base loads a spring and forms a hitting nail bar thereon. The motor has a stator and a rotator attached on an outer wall of the stator. A flywheel is driven by the motor and is configured to engage or disengage the sliding base. The swing base is pivotally mounted on the housing. The motor is installed in the swing base. The electric driver has a rod member driven by electricity to move the swing base to a first position where the flywheel meshes with the sliding base to thereby drive the sliding base to move downwards, or a second position where the flywheel disengages from the sliding base to thereby return the sliding base.

Because actuation of the electrical nailing gun is controlled through a series of electrical control signals, the electrical nailing gun is not provided with any mechanical safety component similar to that used in a conventional pneumatic nailing gun for restricting a series of operating steps to be performed consecutively and properly and to thereby prevent misfiring. Accordingly, when the electrical nailing gun is triggered accidentally, it is likely to run the risk of misfiring nails.

SUMMARY OF THE INVENTION

An object of the present invention is to provide an electrical nailing gun that can prevent misfiring of nails, thus increasing safeness in use.

Accordingly, a nailing gun of the present invention comprises a frame, a flywheel, a hammer unit, a spring plate, a stop member and a safety unit. The flywheel is mounted on the frame and driven by a motor. The hammer unit has a swing arm, and a hammer rod slidably mounted on the swing arm. The swing arm has a first end pivoted to the frame, and a second end that is movable between a first position proximate to the flywheel and a second position distal from the flywheel. The hammer rod is driven by the flywheel to hit a nail when the swing arm is at the first position. The spring plate is fixed to the frame and has a spring end portion resiliently supporting the second end of the swing arm on the frame. The stop member is disposed movably in the frame near the second end of the swing arm to limit the spring end portion and the second end of the swing arm from moving relative to the frame. The safety unit includes a safety member disposed on the frame. The safety member, when subjected to an external pressure, pushes the stop member away from the second end of the swing arm so that the second end of the swing arm is permitted to move together with the spring end portion to the first position. The spring end portion stably retains the second end of the swing arm at the second position when the safety member is not subjected to the external pressure.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
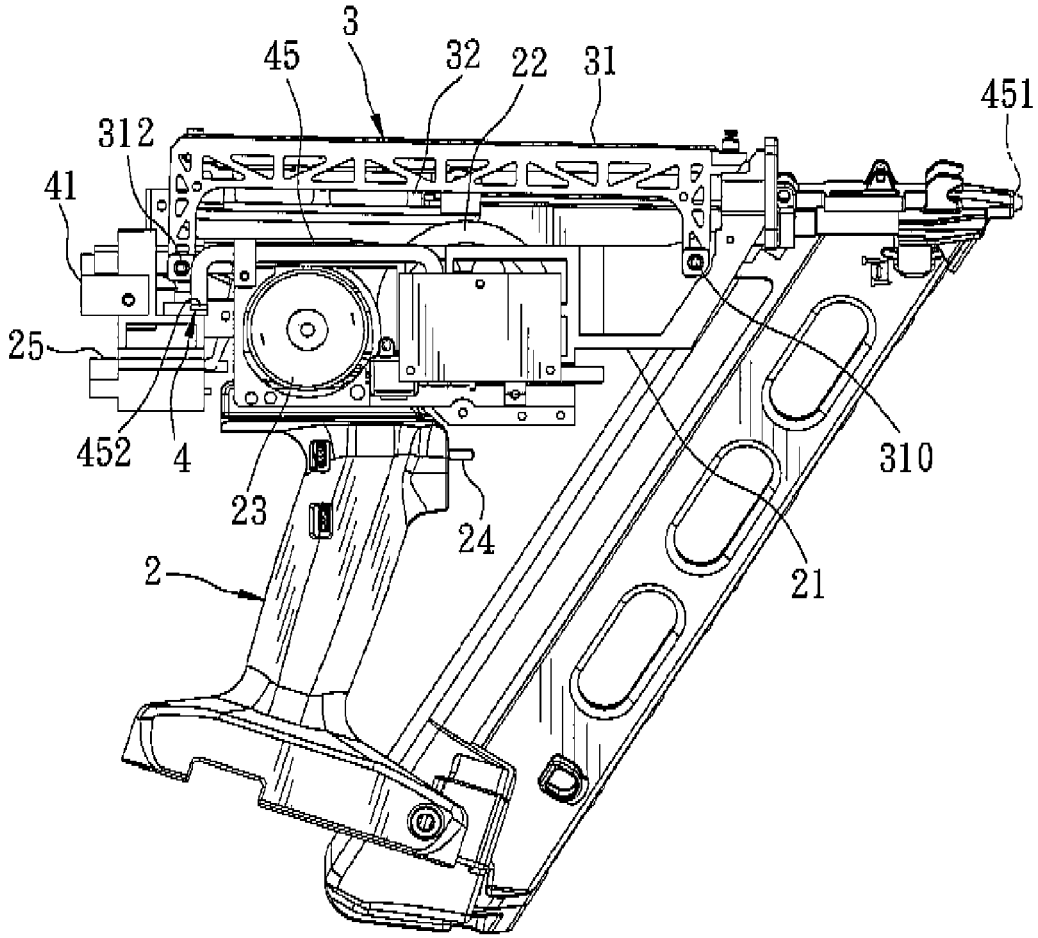
FIG. 1 is an elevation view of the preferred embodiment of a nailing gun according to the present invention.
Figure 2:
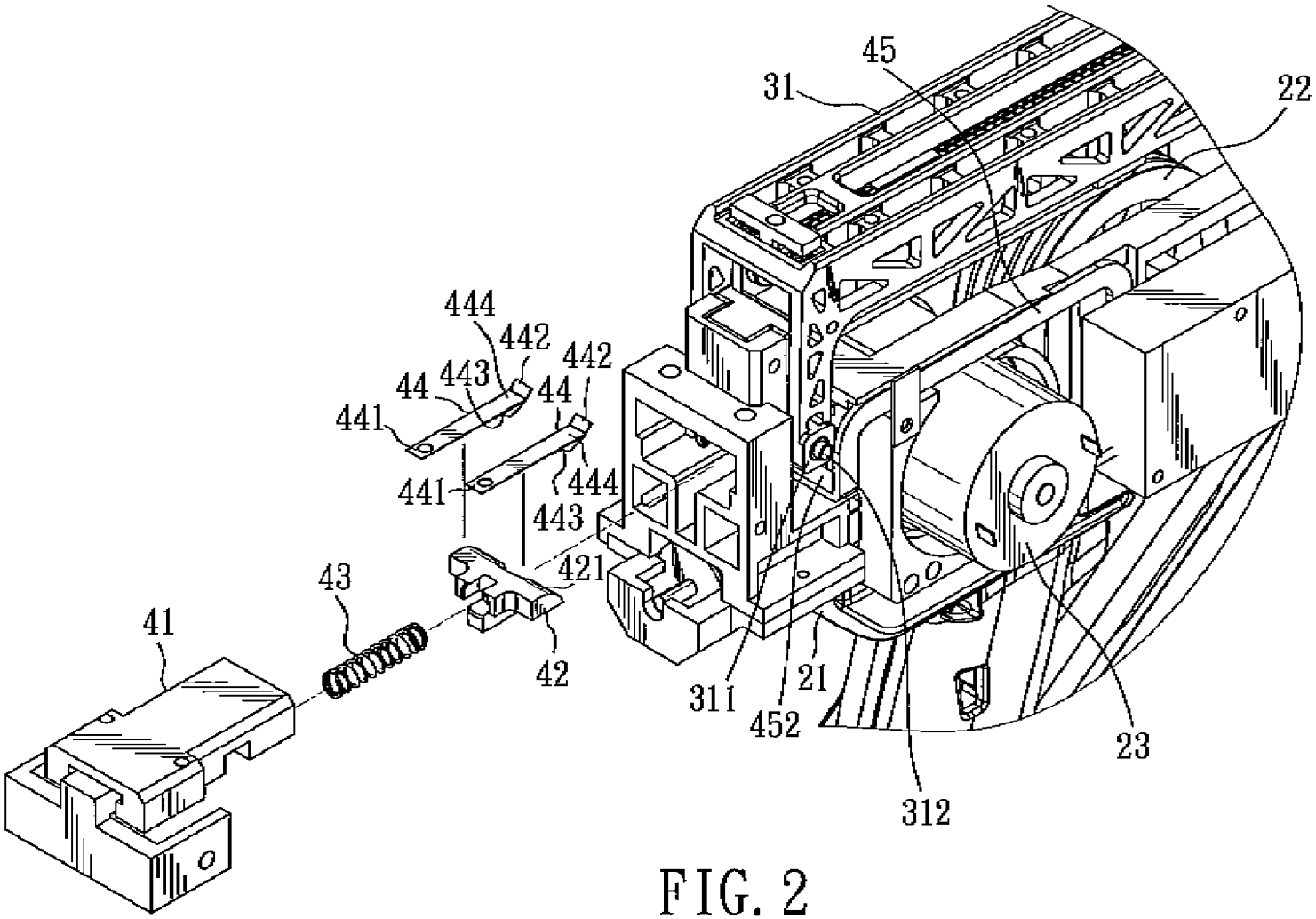
FIG. 2 is a fragmentary exploded view of the preferred embodiment.
Figure 3:
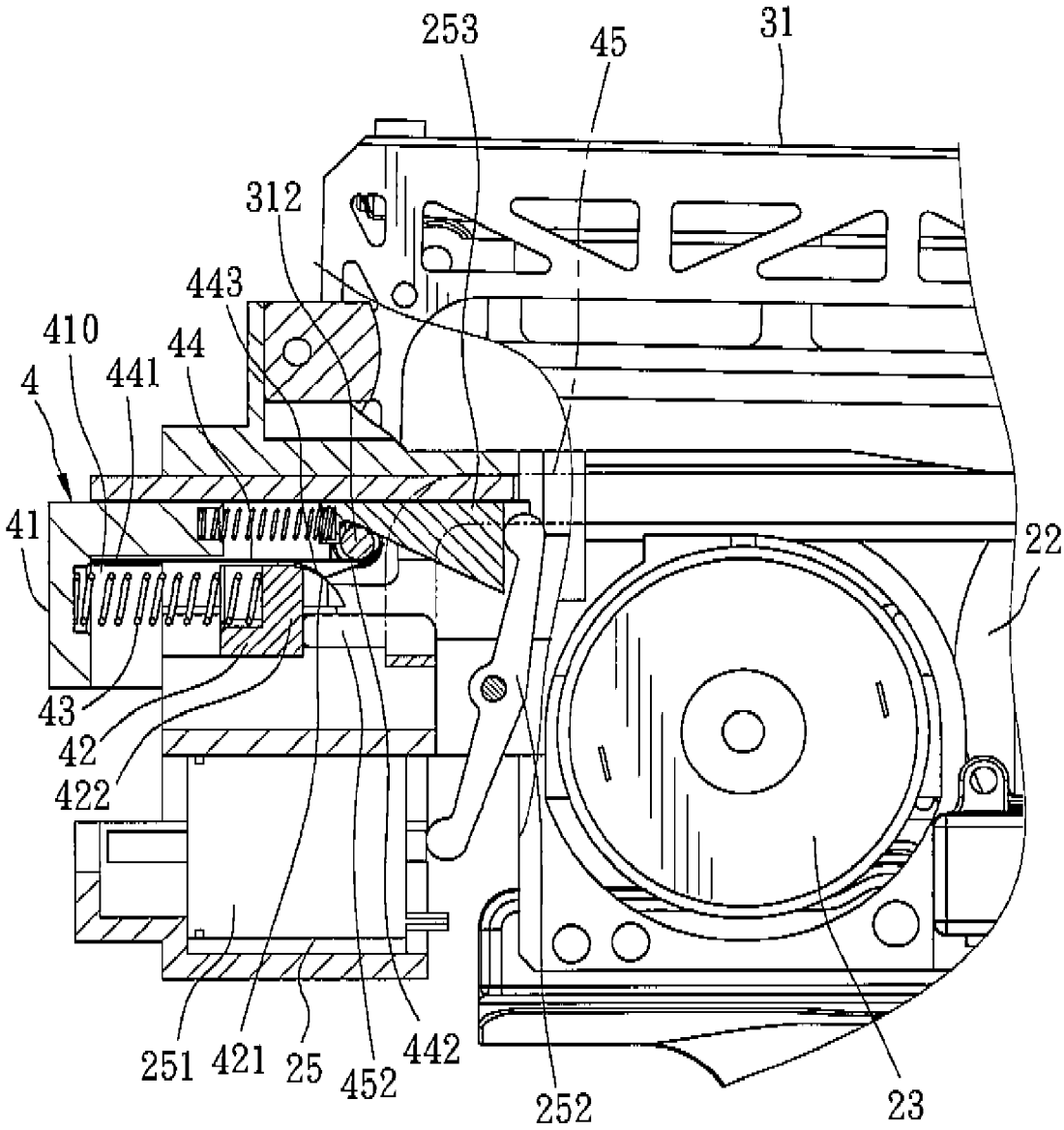
FIG. 3 is a fragmentary sectional view of the preferred embodiment.

As shown in FIGS. 1, 2 and 3, the preferred embodiment of a nailing gun according to the present invention includes a frame 21, a flywheel 22, a hammer unit 3, and a safety unit 4.

The flywheel 22 is mounted on the frame 21 and driven by a motor 23 mounted on the frame 21. The nailing gun further includes a trigger unit 24 mounted pivotally on the frame 21 to actuate a control circuit (not shown) for performing a nailing operation, and an electromagnetic unit 25 mounted on the frame 21 and controlled by the trigger unit 24. The electromagnetic unit 25 includes a solenoid 251, a lever 252 mounted pivotally on the frame 21 and having one end driven by the solenoid 251, and a slant push block 253 driven by another end of the lever 252.

Figure 4:
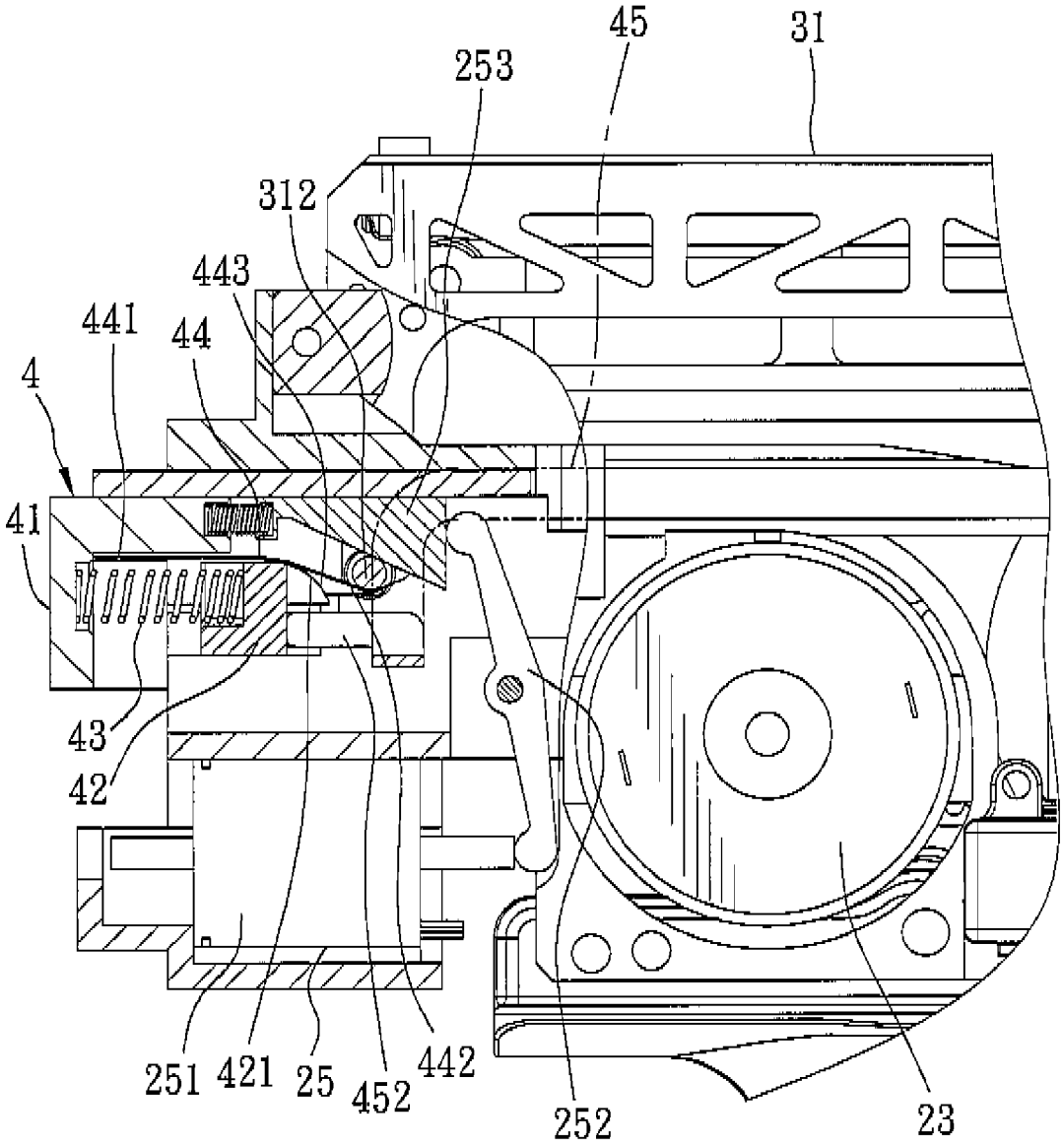
FIG. 4 is the same view as FIG. 3, but showing that a spring end portion of a spring plate is flexed.

The hammer unit 3 has a swing arm 31 mounted pivotally on the frame 21 to extend along the frame 21, and a hammer rod 32 slidably mounted on the swing arm 31. The swing arm 31 has a first end 310 pivoted to the frame 21, and a second end 311 that is movable between a first position proximate to the flywheel 22 as best shown in FIG. 4 and a second position distal from the flywheel 22 as best shown in FIG. 3. The hammer rod 32 is driven by the flywheel 22 to hit a nail when the swing arm 31 is at the first position.

The safety unit 4 includes a retention seat 41, a stop member 42, and a biasing member 43, two spring plates 44, and a safety member 45. The retention seat 41 is fixed to the frame 21 in proximity to the second end 311 of the swing arm 31. The stop member 42 is disposed slidably in the frame 21 near the second end 311 of the swing arm 31 and has an abutment part configured as a convexed surface 421 to face the swing arm 31. The biasing element 43 is disposed in the retention seat 41.

Each of the spring plates 44 has a fixed end 441 fixed to the frame 21 and a spring end portion 442. The spring end portion 442 has as a concaved surface 443 to complement with the convexed surface 421 of the stop member 42. The spring end portions 442 of the spring plates 44 are used to support resiliently the second end 311 of the swing arm 31 on the frame 21.

The safety member 45 is disposed movably on and extend along the frame 21, and has a press end 451 to press an object to be nailed (not shown), and a push end 452 disposed oppositely of the press end 451 to push the stop member 42. When no external force acts on the press end 451 of the safety member 45 (i.e. when the press end 451 is not pressed against the object to be nailed), the biasing member 43 pushes the stop member 42 until the convexed surface 421 contacts against the concaved surface 443 of the spring end portions 442 so that the spring end portion 442 is limited by the stop member 42 to restrict the second end 311 of the swing arm 31 from moving relative to the frame 21.

In particular, as best shown in FIGS. 2 and 3, the second end 311 of the swing member 31 has two projecting bearing parts 312 (only one is shown) respectively supported on bearing faces 444 of the spring end portions 992 of the spring plates 49. Each spring end portion 942 is bent upward at the end thereof and is thereafter folded downward and backward and curved to form the concaved surface 443. The spring end portions 442 are disposed in a cantilever fashion to extend beneath and carry the bearing parts 312.

Referring back to FIGS. 3 and 4, the biasing member 93 and the stop member 42 are disposed beneath the spring plates 94. The stop member 42 further has a contact part 422 disposed below the convexed surface 921 to abut against the push end 452 of the safety member 45. The retention seat 41 is spaced apart from the push end 452 of the safety member 45 and has a receiving space 410 to receive the spring plates 44, the biasing element 43 and the stop member 42. The spring end portions 442 and the stop member 42 project outward from the receiving space 410 toward the bearing parts 312 of the swing arm 31 and the push end 452 of the safety member 45, respectively. The spring end portions 442 extend beyond the stop member 42 and are suspended in a cantilever fashion.

In a normal state, the flywheel 22 is spaced apart from the hammer rod 32 by a distance of 0.5 mm. Upon power-on, the motor 23 drives the flywheel 22 to idle and accumulate dynamic energy. At this moment, the press end 451 of the safety member 45 protrudes slightly out of the frame 21. Since the stop member 42 is pushed outward to contact against the push end 452 of the safety member 45, the length that the spring end portions 442 extend beyond the stop member 42 to float is shortened, and the stiffness of the spring end portions 442 is increased producing an increased bearing force to limit the second end 311 of the swing arm 31 from moving relative to the frame 21. As a result, the spring end portions 442 stably retain the second end 311 of the swing arm 31 at the second position.

Referring to FIG. 4, to hit the nail, the frame 21 is oriented with respect to the object to be nailed, and the press end 451 of the safety member 45 is pressed against the object to be nailed. As the result, the safety member 45 is displaced along the frame 21 toward the retention seat 41, and the push end 452 pushes the stop member 42 to slide along the frame 21 against the biasing force of the biasing element 43. Accordingly, the length that the spring end portions 442 extend beyond the stop member 42 increases, and the stiffness of the spring end portions 442 decreases. Therefore, the spring plates 49 produce less force to retain the second end 311 of the swing arm 31 in the second position.

When the user operates the trigger unit 24, the control circuit (not shown) is actuated to drive the solenoid 251 so that the solenoid 251 moves the lever 252 to push the slant push block 253. The inclined face of the slant push block 253 pushes the second end 311 of the swing arm 31 to move against the resilient force of the spring end portions 442. Therefore, the spring end portions 442, which have less bearing force 44, are flexed permitting the second end 311 of the swing arm 31 to move downward and toward the first position and the flywheel 22. The hammer rod 32 is thus moved to the flywheel 22 by the swing arm 31 to contact the flywheel 22. The dynamic force of the motor 23 and the dynamic energy of the flywheel 22 are transmitted to the hammer rod 32 to perform the nail-hitting operation.

When the safety member 45 and the trigger unit 24 are released, the push end 452 of the safety member 45 no longer pushes the stop member 42. However, because the biasing element 43 biases the stop member 42 to move toward and contact the push end 452, the length that the spring end portions 442 extend beyond of the stop member 42 is shortened again so that an increased force is produced to return the second end 311 of the swing arm 31 to the second position.

As mentioned hereinbefore, when the safety member 95 does not press the object to be nailed, the stop member 42 causes the spring end portions 442 to produce a larger bearing force to restrict the second end 311 of the swing arm 31 from moving relative to the frame 21. At this state, even when the trigger unit 24 is triggered, the swing arm 31 cannot be moved to the first position because the second end 311 thereof is restricted by the spring end portions 442. Therefore, the problem of misfiring can be effectively prevented.

By virtue of the safety member 45 to control the stop member 42, which can vary the stiffness (bearing force) of the spring end portions 442 of the spring plates 44, the nailing gun of this invention can hit a nail only when the safety member 45 is subjected to the external pressure.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A nailing gun comprising:

a frame;

a flywheel mounted on said frame and driven by a motor;

a hammer unit having a swing arm, and a hammer rod slidably mounted on said swing arm, said swing arm having a first end pivoted to said frame, and a second end that is movable between a first position proximate to said flywheel and a second position distal from said flywheel, said hammer rod being driven by said flywheel to hit a nail when said swing arm is at the first position;

a spring plate fixed to said frame and having a spring end portion resiliently supporting said second end of said swing arm on said frame;

a stop member disposed movably in said frame near said second end of said swing arm to limit said spring end portion and said second end of said swing arm from moving relative to said frame; and a safety unit including a safety member disposed on said frame, said safety member, when subjected to an external pressure exerted by an object to be nailed, pushing said stop member away from said second end of said swing arm so that said second end of said swing arm is permitted to move together with said spring end portion to the first position;

wherein said spring end portion stably retains said second end of said swing arm at the second position when said safety member is not subjected to the external force and does not push said stop member.

2. The nailing gun as claimed in claim 1, wherein said safety member is disposed movably in and extends along said frame, and having a press end adapted to press the object to be nailed, and a push end proximate to said stop member and disposed oppositely of said press end to push said stop member.

3. The nailing gun as claimed in claim 2, wherein said safety unit further includes a biasing element to bias said stop member to push said spring end portion against said second end of said swing arm and to thereby limit said second end from moving to said first position from said second position when said safety member is not subjected to the external pressure.

4. The nailing gun as claimed in claim 3, wherein said second end of said swing arm has a bearing part projecting therefrom, said spring end portion extending beneath said bearing part in a cantilever fashion to carry said bearing part, said spring end portion being flexed when said second end of said swing arm is in said first position.

5. The nailing gun as claimed in claim 4, wherein said biasing element and said stop member are disposed beneath said spring plate, said stop member having an abutment part to abut against said spring end portion below said bearing part of said swing arm, and a contact part disposed below said abutment part to abut against said push end of said safety member.

6. The nailing gun as claimed in claim 5, wherein said safety unit further includes a retention seat fixed to said frame and spaced apart from said push end of said safety member, said retention seat having a receiving space to receive said spring plate, said biasing element and said stop member, said spring plate further having a fixed end fixed to said retention seat, said spring end portion and said stop member projecting outward from said receiving space and extending toward said bearing part of said swing arm and said push end of said safety member, respectively.

7. The nailing gun as claimed in claim 6, wherein said abutment part of said stop member has a convexed surface to contact said spring end portion, said spring end portion having a concaved surface complementing with said convexed surface.

* * * * *